US010983449B2

(12) United States Patent
Maruyama et al.

(10) Patent No.: US 10,983,449 B2
(45) Date of Patent: Apr. 20, 2021

(54) METHOD FOR MANUFACTURING ELECTROPHOTOGRAPHIC PHOTOCONDUCTOR

(71) Applicant: CANON KABUSHIKI KAISHA, Tokyo (JP)

(72) Inventors: Akihiro Maruyama, Mishima (JP); Kazuko Araki, Tokyo (JP); Daisuke Miura, Tokyo (JP); Tatsuya Yamaai, Yokohama (JP); Hiroto Hirayama, Suntou-gun (JP); Shinobu Iijima, Joso (JP); Daisuke Kawaguchi, Kashiwa (JP); Takahiro Nagase, Toride (JP); Takahisa Taniguchi, Nagareyama (JP); Shintarou Goto, Toride (JP); Taneyuki Kinoshita, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/828,309

(22) Filed: Mar. 24, 2020

(65) Prior Publication Data

US 2020/0310262 A1 Oct. 1, 2020

(30) Foreign Application Priority Data

Mar. 28, 2019 (JP) ..... JP2019-063892
Feb. 27, 2020 (JP) ..... JP2020-032298

(51) Int. Cl.
*G03G 5/047* (2006.01)
*G03G 5/05* (2006.01)

(52) U.S. Cl.
CPC ..... *G03G 5/0525* (2013.01); *G03G 5/047* (2013.01)

(58) Field of Classification Search
CPC ..... G03G 5/05; G03G 5/047
See application file for complete search history.

(56) References Cited

FOREIGN PATENT DOCUMENTS

| | | | | |
|---|---|---|---|---|
| JP | 10-177258 A | | 6/1998 | |
| JP | 2000-194147 | * | 7/2000 | ..... G03G 5/05 |
| JP | 2006-337921 A | | 12/2006 | |
| JP | 2014-160238 A | | 9/2014 | |
| JP | 2016-200732 A | | 12/2016 | |
| JP | 2017-156473 A | | 9/2017 | |

OTHER PUBLICATIONS

Translation of JP 2000-194147.*

* cited by examiner

*Primary Examiner* — Peter L Vajda
(74) *Attorney, Agent, or Firm* — Canon U.S.A., Inc. IP Division

(57) ABSTRACT

A method for manufacturing an electrophotographic photoconductor including a charge generating layer and a charge transport layer in this order on a cylindrical electrically-conductive support including the steps of: (i) immersing the support in a charge generating layer coating liquid, (ii) pulling the support out of the coating liquid, (iii) heat drying the support coated with the coating liquid to form the charge generating layer, (iv) cooling the charge generating layer, and (v) immersing the support on which the charge generating layer has been formed in a charge transport layer coating liquid while retaining gas inside of the support. The charge transport layer coating liquid contains a solvent having a boiling point of 34° C. or more and 85° C. or less, and the step (v) satisfies two specific conditions.

3 Claims, 1 Drawing Sheet

METHOD FOR MANUFACTURING ELECTROPHOTOGRAPHIC PHOTOCONDUCTOR

BACKGROUND OF THE INVENTION

Field of the Invention

The present disclosure relates to a method for manufacturing an electrophotographic photoconductor.

Description of the Related Art

In an image forming process, an electrophotographic photoconductor is repeatedly subjected to charging, exposure, development, transfer, cleaning, and discharging steps. Furthermore, there has been a demand for an improvement in the image performance of electrophotographic apparatuses in recent years. In this context, to achieve a further improvement in image performance, a photosensitive layer formed by performing coating desirably exhibits a higher level of uniformity in film thickness throughout the layer than in the related art.

To improve uniformity in film thickness, the viscosity of a coating liquid in the vicinity of a support needs to be kept constant during immersion-coating. In steps of continuously producing electrophotographic photoconductors having a multilayer structure, when a plurality of coating liquid layers are stacked, by continuously forming layers of different coating liquids, the temperature of a support is high because a pretreatment has been performed by heat drying a coating film that has been formed on the support before the support is immersed in a coating liquid. When the support is immersed in this coating liquid for the next step, the large temperature difference between the support and the coating liquid causes a large viscosity change in the vicinity of the support during immersion, which hinders the uniformity of the film thickness of the coating film. Thus, in view of uniformity in film thickness, the temperature of the support immediately before immersion in the coating liquid can be close to the temperature of the coating liquid. However, when the temperature difference between the support and the coating liquid is excessively small, the air inside the support is released (hereafter referred to as "foaming") from a lower end of the support during immersion, potentially causing a defect on the coating film.

Regarding an immersion-coating method, which is a common method for manufacturing an electrophotographic photoconductor, various research has been conducted in an effort to achieve the uniformity in film thickness throughout a photosensitive layer.

Japanese Patent Laid-Open No. 10-177258 discloses a manufacturing method for obtaining a uniform coating film by, before a support is immersion-coated with a coating liquid, controlling the difference between the average temperature of the support and the temperature of the coating liquid and the difference between the temperature of an upper portion of the support and the temperature of a lower portion of the support. However, according to the method, it is believed to be difficult to produce a charge transport layer on a charge generating layer having further uniformity in the film thickness thereof.

SUMMARY OF THE INVENTION

One aspect of the present disclosure is directed to providing a method for manufacturing an electrophotographic photoconductor where a charge transport layer formed on a charge generating layer through an immersion-coating method has higher uniformity in film thickness.

According to one aspect of the present disclosure, there is provided a method for manufacturing an electrophotographic photoconductor including a charge generating layer and a charge transport layer in this order on a cylindrical electrically-conductive support, including the steps of:

(i) immersing the electrically-conductive support in a charge generating layer coating liquid, (ii) pulling the electrically-conductive support out of the charge generating layer coating liquid, (iii) heat drying the electrically-conductive support coated with the charge generating layer coating liquid to form the charge generating layer, (iv) cooling the charge generating layer, (v) subjecting the electrically-conductive support on which the charge generating layer has been formed to immersion-coating with a charge transport layer coating liquid while retaining gas inside a cylinder space of the electrically-conductive support to form a coating film of the charge transport layer coating liquid on the charge generating layer, and (vi) drying the coating film of the charge transport layer coating liquid to form the charge transport layer, where the charge transport layer coating liquid contains a solvent having a boiling point of 34° C. or more and 85° C. or less, and the step (v) satisfies the Conditions 1 and 2 below:

Condition 1: Before the electrically-conductive support is immersed in the charge transport layer coating liquid, a difference between a maximum value and a minimum value of surface temperatures in regions T1 to T5, the regions being formed by dividing the charge generating layer on the electrically-conductive support into fifths in a longitudinal direction, is 1.0° C. or less, provided that the maximum value and the minimum value are selected from all values measured at four locations in each of the regions T1 to T5 in a circumferential direction; and Condition 2: Before the electrically-conductive support is immersed in the charge transport layer coating liquid, an average of surface temperatures of the charge generating layer formed on the electrically-conductive support is higher than a temperature of the charge transport layer coating liquid, and a difference between the average and the temperature of the charge transport layer coating liquid is 1.5° C. or more and 5.0° C. or less, provided that the average of the surface temperatures is an average of all the values measured at four locations in each of the regions T1 to T5 in a circumferential direction.

Further features of the present disclosure will become apparent from the following description of exemplary embodiments with reference to the attached drawings.

DESCRIPTION OF THE EMBODIMENTS

Figure 1:
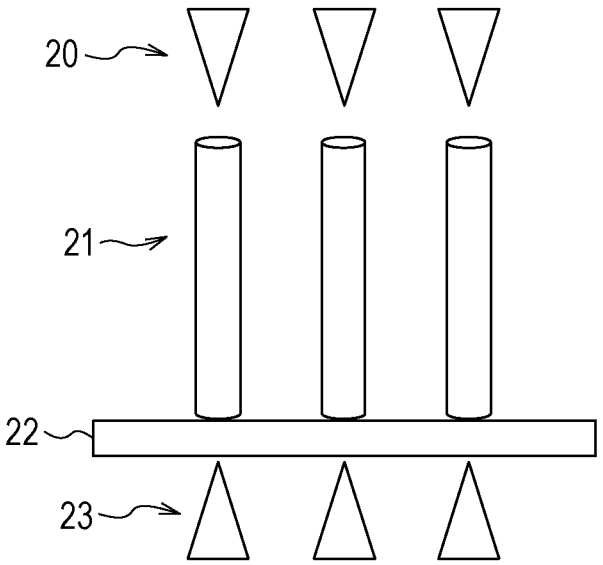
FIG. 1 is a schematic view of an apparatus used in the process of manufacturing an electrophotographic photoconductor according to an embodiment of the present disclosure.

Hereafter, the present disclosure will be described in detail with reference to embodiments.

Research by the present inventors reveals that, when a charge transport layer is formed on a charge generating layer through an immersion-coating method, the uniformity of the surface temperature of the charge generating layer in the longitudinal direction, the layer to be coated with a charge transport layer coating liquid, has a significant impact on the uniformity of the film thickness of the charge transport layer to be obtained.

Thus, a method for manufacturing an electrophotographic photoconductor according to one aspect of the present disclosure is a method for manufacturing an electrophotographic photoconductor including a charge generating layer and a charge transport layer in this order on a cylindrical electrically-conductive support, including the steps of:

(i) immersing the electrically-conductive support in a charge generating layer coating liquid, (ii) pulling the electrically-conductive support out of the charge generating layer coating liquid, (iii) heat drying the electrically-conductive support coated with the charge generating layer coating liquid to form the charge generating layer, (iv) cooling the charge generating layer, (v) subjecting the electrically-conductive support on which the charge generating layer has been formed to immersion-coating with a charge transport layer coating liquid while retaining gas inside a cylinder space of the electrically-conductive support to form a coating film of the charge transport layer coating liquid on the charge generating layer, and (vi) drying the coating film of the charge transport layer coating liquid to form the charge transport layer, where the charge transport layer coating liquid contains a solvent having a boiling point of 34° C. or more and 85° C. or less, and the step (v) satisfies the Conditions 1 and 2 below:

Condition 1: Before the electrically-conductive support is immersed in the charge transport layer coating liquid, a difference between a maximum value and a minimum value of surface temperatures in regions T1 to T5, the regions being formed by dividing the charge generating layer on the electrically-conductive support into fifths in a longitudinal direction, is 1.0° C. or less, provided that the maximum value and the minimum value are selected from all values measured at four locations in each of the regions T1 to T5 in a circumferential direction; and Condition 2: Before the electrically-conductive support is immersed in the charge transport layer coating liquid, an average of surface temperatures of the charge generating layer formed on the electrically-conductive support is higher than a temperature of the charge transport layer coating liquid, and a difference between the average and the temperature of the charge transport layer coating liquid is 1.5° C. or more and 5.0° C. or less, provided that the average of the surface temperatures is an average of all the values measured at four locations in each of the regions T1 to T5 in a circumferential direction.

Hereafter, the Conditions 1 and 2 will be described.

The Conditions 1 and 2 are conditions for the step (v) where the charge generating layer formed on the electrically-conductive support (hereafter also simply referred to as the "support") is immersed in the charge transport layer coating liquid.

To achieve higher uniformity in film thickness, the viscosity change of the coating liquid in the vicinity of the support during immersion-coating needs to be minimized. However, due to the prior step of heat drying, variation in temperature occurs in the charge generating layer in the longitudinal direction of the support and in the circumferential direction of the support before the next step of immersing the support in the coating liquid. Thus, the viscosity change of the coating liquid in the vicinity of the support during immersion-coating occurs, and as a result, the uniformity of the film thickness of the charge transport layer is hindered. Accordingly, it is important to keep the surface temperature of the charge generating layer on the support more constant.

To achieve higher uniformity in film thickness, the following condition is required. That is, the charge generating layer on the support is divided into fifths in the longitudinal direction, the fifths being named T1, T2, T3, T4, and T5, respectively, surface temperatures at four locations in each of the regions in the circumferential direction are measured, the maximum value and the minimum value are determined on the basis of the surface temperatures of the charge generating layer measured at four locations in the region T1, at four locations in the region T2, at four locations in the region T3, at four locations in the region T4, and at four locations in the region T5, namely, at a total of 20 locations, and the difference between the maximum value and the minimum value of the temperatures is 1.0° C. or less. The expression "The average of the surface temperatures" refers to the average of the surface temperatures measured at the 20 locations.

When the difference between the average of the surface temperatures of the charge generating layer formed on the support and the temperature of a liquid containing a material for the charge transport layer (hereafter referred to as a "charge transport layer coating liquid") is less than 1.5° C., the release of air inside the cylinder of the support from a lower end thereof (foaming) occurs during immersion, which significantly hinders the uniformity in film thickness. Furthermore, when the temperature difference is more than 5.0° C., a large temperature change of the charge transport layer coating liquid occurs during continuous production. As a result, a change in the viscosity of the liquid also occurs, resulting in a change in film thickness, which is undesirable. Thus, the average of the surface temperatures of the charge generating layer formed on the support and the temperature of the charge transport layer coating liquid need to satisfy the following conditions: The average of the surface temperatures is higher than the temperature of the charge transport layer coating liquid, and the difference between the average and the temperature of the charge transport layer coating liquid is 1.5° C. or more and 5.0° C. or less.

The average of the surface temperatures of the charge generating layer formed on the support is preferably 20° C. or more and 28° C. or less, more preferably 20° C. or more and 25° C. or less, in view of suppressing the occurrence of a change in coating liquid viscosity when the support is immersion-coated with the charge transport layer coating liquid.

The temperature of the charge transport layer coating liquid is preferably 17° C. or more and 30° C. or less, more preferably 17° C. or more and 22° C. or less, in view of suppressing the occurrence of solvent volatilization.

The charge transport layer coating liquid needs to contain a solvent having a boiling point of 34° C. or more and 85° C. or less to improve the uniformity in film thickness. During immersion-coating, the moment the coated support is pulled out of the liquid surface of the coating liquid to be exposed to air, solvent volatilization begins to proceed. As a result, as the solid content of the coating liquid increases, the viscosity of the coating liquid increases, resulting in a loss of fluidity of the coating film, which leads to film deposition. When a low-boiling-point solvent is contained, the loss of fluidity of the coating film at this time occurs in a shorter time. As a result, the coating film becomes less prone to the impact of surrounding airflow, enabling improvement in the uniformity in film thickness. The term "low-boiling-point solvent" refers to a solvent having a boiling point of 34° C. or more and 85° C. or less. A group of examples of the solvent is presented in the following Table.

TABLE 1

| Solvent | Boiling point (° C.) |
|---|---|
| Methanol | 64.7 |
| Ethanol | 78.3 |
| Isopropanol | 82.3 |
| tert-Butanol | 82.5 |
| Acetone | 56.1 |
| Methyl acetate | 56.5 |
| Ethyl acetate | 77.1 |
| Methyl ethyl ketone | 79.6 |
| Tetrahydrofuran | 65.0 |
| Acetonitrile | 81.3 |
| Diethyl ether | 34.6 |
| Chloroform | 61.3 |
| Dichloromethane | 39.8 |
| Dimethoxymethane | 42.5 |

Examples of the solvent used for the coating liquid include alcohol solvents, ketone solvents, ether solvents, ester solvents, and aromatic hydrocarbon solvents. Among these, ether solvents or aromatic hydrocarbon solvents are preferable.

FIG. 1 illustrates an example of an apparatus used in the method for manufacturing an electrophotographic photoconductor according to the present disclosure.

In the steps of manufacturing an electrophotographic photoconductor, a step of applying a charge transport layer coating liquid is preceded by prior steps of forming a charge generating layer on a cylindrical electrically-conductive support. Specifically, a step of immersing the support in a liquid containing a material for a charge generating layer (hereafter referred to as a "charge generating layer coating liquid"), a step of applying a charge generating layer to the support, a step of heat drying the charge generating layer, and a step of cooling the charge generating layer are performed. FIG. 1 illustrates an example of an apparatus used in the step of cooling the charge generating layer. In FIG. 1, "21" denotes cylindrical electrically-conductive supports with the charge generating layer applied thereto and "22" denotes a base (palette) where the supports are placed.

Furthermore, in FIG. 1, "20" and "23" denote fanning mechanisms. As illustrated, the fanning mechanisms 20 are mechanisms that deliver airflow to each of the supports from above the supports and the fanning mechanisms 23 are mechanisms that deliver airflow to each of the supports from below the supports. By adjusting the temperature, the strength, and the time of the airflow from the fanning mechanisms 20 or 23, each of the supports can be controlled to a predetermined temperature. However, the time taken from the step of heat drying the charge generating layer to the step of immersing each of the supports in the charge transport layer coating liquid is preferably eight minutes or less in view of production efficiency, more preferably five minutes or less in view of further improving production efficiency, and even more preferably three minutes or less in view of still further improving production efficiency.

Electrophotographic Photoconductor

An electrophotographic photoconductor according to one aspect of the present disclosure includes a charge generating layer and a charge transport layer in this order on a cylindrical electrically-conductive support.

A method for manufacturing such an electrophotographic photoconductor may be a method of preparing coating liquids for the below-described layers, applying the coating liquids in a desired order of the layers, and performing drying. Examples of methods for applying the coating liquids at this time include immersion-coating, spray coating, inkjet coating, roll coating, die coating, blade coating, curtain coating, wire bar coating, and ring coating. Among these, in view of efficiency and productivity, immersion-coating is preferable.

Hereafter, each of the layers will be described.

Support

The support is cylindrical. The surface of the support may be subjected to electrochemical treatment such as anodizing, blast treatment, cutting treatment, or the like.

The material for the support can be a metal, a resin, glass, or the like.

Examples of the metal include aluminum, iron, nickel, copper, gold, stainless steel, and alloys of the foregoing. Among these, the support is preferably an aluminum support formed of aluminum.

When the support formed of a resin or glass is used, the support can serve as the electrically-conductive support according to the present disclosure by mixing an electrically-conductive material in the material or by covering the surface of the support with an electrically-conductive material.

Electrically-Conductive Layer

An electrically-conductive layer, which is an optional component, may be disposed on the support. By disposing an electrically-conductive layer, scratches and uneven areas of the support surface can be masked and light reflection on the support surface can be controlled.

The electrically-conductive layer can contain electrically-conductive particles and a resin.

Examples of the material for electrically-conductive particles include a metal oxide, a metal, and carbon black.

Examples of the metal oxide include zinc oxide, aluminum oxide, indium oxide, silicon oxide, zirconium oxide, tin oxide, titanium oxide, magnesium oxide, antimony oxide, and bismuth oxide. Examples of the metal include aluminum, nickel, iron, nichrome, copper, zinc, and silver.

Among these, the metal oxide is preferably used as electrically-conductive particles, and titanium oxide, tin oxide, or zinc oxide is particularly preferably used.

When the metal oxide is used as electrically-conductive particles, the surface of the metal oxide may be treated with a silane coupling agent, or the metal oxide may be doped with an element such as phosphorus or aluminum or with an oxide of the foregoing.

Furthermore, the electrically-conductive particles may have a multilayer structure including a core material particle and a covering layer that covers the core material particle. The core material particle is formed of, for example, titanium oxide, barium sulfate, or zinc oxide. The covering layer is formed of, for example, a metal oxide such as tin oxide.

Furthermore, when the metal oxide is used as electrically-conductive particles, the particles preferably have a volume average particle size of 1 nm or more and 500 nm or less, more preferably 3 nm or more and 400 nm or less.

Examples of the resin include polyester resins, polycarbonate resins, polyvinyl acetal resins, acrylic resins, silicone resins, epoxy resins, melamine resins, polyurethane resins, phenolic resins, and alkyd resins.

Furthermore, the electrically-conductive layer may further contain a masking agent such as silicone oil, resin particles, or titanium oxide.

The average film thickness of the electrically-conductive layer is preferably 1 μm or more and 50 μm or less, particularly preferably 3 μm or more and 40 μm or less.

The electrically-conductive layer can be formed by preparing an electrically-conductive layer coating liquid containing the above-described materials and a solvent, forming a coating film of the liquid, and drying the coating film. Examples of the solvent used for the coating liquid include alcohol solvents, sulfoxide solvents, ketone solvents, ether solvents, ester solvents, and aromatic hydrocarbon solvents. Examples of the dispersion method for dispersing electrically-conductive particles in the electrically-conductive layer coating liquid include methods using a paint shaker, a sand mill, a ball mill, or a high-speed liquid-liquid collision dispersion machine.

Undercoat Layer

An undercoat layer, which is an optional component, may be further disposed on the support or on the electrically-conductive layer. By disposing an undercoat layer, the adhesion function between the layers is improved. As a result, a charge injection block function can be imparted thereto.

The undercoat layer can contain a resin. Furthermore, the undercoat layer may be formed by polymerizing a composition containing a monomer having a polymerizable functional group and thereby forming a cured film.

Examples of the resin include polyester resins, polycarbonate resins, polyvinyl acetal resins, acrylic resins, epoxy resins, melamine resins, polyurethane resins, phenolic resins, polyvinyl phenolic resins, alkyd resins, polyvinyl alcohol resins, polyethylene oxide resins, polypropylene oxide resins, polyamide resins, polyamide acid resins, polyimide resins, polyamide-imide resins, and cellulose resins.

Examples of the polymerizable functional groups of the monomer having a polymerizable functional group include isocyanate groups, blocked isocyanate groups, methylol groups, alkylated methylol groups, epoxy groups, metal alkoxide groups, hydroxyl groups, amino groups, carboxyl groups, thiol groups, carboxylic anhydride groups, and carbon-carbon double-bond groups.

Furthermore, the undercoat layer may further contain a charge transport material, a metal oxide, a metal, or an electrically-conductive polymer to improve electrical properties. Among these, an electron transport material or a metal oxide is preferably used.

Examples of the charge transport material include quinone compounds, imide compounds, benzimidazole compounds, cyclopentadienylidene compounds, fluorenone compounds, xanthone compounds, benzophenone compounds, cyanovinyl compounds, aryl halide compounds, silole compounds, and boron-containing compounds. An electron transport material having a polymerizable functional group may be used as the electron transport material, and the undercoat layer may be formed by copolymerizing the material with a monomer having any of the above-described polymerizable functional groups and thereby forming a cured film.

Examples of the metal oxide include indium tin oxide, tin oxide, indium oxide, titanium oxide, zinc oxide, aluminum oxide, and silicon dioxide. Examples of the metal include gold, silver, and aluminum.

Furthermore, the undercoat layer may further contain additives.

The average film thickness of the undercoat layer is preferably 0.1 μm or more and 50 μm or less, more preferably 0.2 μm or more and 40 μm or less, and particularly preferably 0.3 μm or more and 30 μm or less.

The undercoat layer can be formed by preparing an undercoat layer coating liquid containing the above-described materials and a solvent, forming a coating film of the liquid, and drying and/or curing the coating film. Examples of the solvent used for the coating liquid include alcohol solvents, ketone solvents, ether solvents, ester solvents, and aromatic hydrocarbon solvents.

Photosensitive Layer

The photosensitive layer is a multilayered photosensitive layer including a charge generating layer containing a charge generating material, the layer positioned on a side closer to the support, and a charge transport layer containing a charge transport material, the layer positioned on a side opposed to the support-facing side of the charge generating layer.

1-1 Charge Generating Layer

The charge generating layer can contain a charge generating material and a resin.

Examples of the charge generating material include azo pigments, perylene pigments, polycyclic quinone pigments, indigo pigments, and phthalocyanine pigments. Among these, azo pigments and phthalocyanine pigments are preferable. Among phthalocyanine pigments, oxytitanium phthalocyanine pigments, chlorogallium phthalocyanine pigments, and hydroxygallium phthalocyanine pigments are preferable.

The content of the charge generating material in the charge generating layer is preferably 40% by mass or more and 85% by mass or less, more preferably 60% by mass or more and 80% by mass or less, with respect to the total mass of the charge generating layer.

Examples of the resin include polyester resins, polycarbonate resins, polyvinyl acetal resins, polyvinyl butyral resins, acrylic resins, silicone resins, epoxy resins, melamine resins, polyurethane resins, phenolic resins, polyvinyl alcohol resins, cellulose resins, polystyrene resins, polyvinyl acetate resins, and polyvinyl chloride resins. Among these, polyvinyl butyral resins are more preferable.

Furthermore, the charge generating layer may further contain additives such as antioxidants and ultraviolet absorbers. Specific examples of the additives include hindered phenolic compounds, hindered amine compounds, sulfur compounds, phosphorus compounds, and benzophenone compounds.

The average film thickness of the charge generating layer is preferably 0.1 μm or more and 1 μm or less, more preferably 0.15 μm or more and 0.4 μm or less.

The charge generating layer can be formed by preparing a charge generating layer coating liquid containing the above-described materials and a solvent, forming a coating film of the liquid, and drying the coating film. Examples of the solvent used for the coating liquid include alcohol solvents, sulfoxide solvents, ketone solvents, ether solvents, ester solvents, and aromatic hydrocarbon solvents.

1-2 Charge Transport Layer

The charge transport layer can contain a charge transport material and a resin.

Examples of the charge transport material include polycyclic aromatic compounds, heterocyclic compounds, hydrazone compounds, styryl compounds, enamine compounds, benzidine compounds, triarylamine compounds, and resins containing groups that are derived from the foregoing materials. Among these, triarylamine compounds and benzidine compounds are preferable.

The content of the charge transport material in the charge transport layer is preferably 25% by mass or more and 70% by mass or less, more preferably 30% by mass or more and 55% by mass or less, with respect to the total mass of the charge transport layer.

Examples of the resin include polyester resins, polycarbonate resins, acrylic resins, and polystyrene resins. Among these, polycarbonate resins and polyester resins are preferable. Among polyester resins, polyarylate resin is particularly preferable.

The ratio (mass ratio) of the content of the charge transport material to the resin is preferably 4:10 to 20:10, more preferably 5:10 to 12:10.

Furthermore, the charge transport layer may further contain additives such as antioxidants, ultraviolet absorbers, plasticizers, leveling agents, slip agents, and abrasion resistance improvers. Specific examples of the additives include hindered phenolic compounds, hindered amine compounds, sulfur compounds, phosphorus compounds, benzophenone compounds, siloxane-modified resins, silicone oil, fluorine resin particles, polystyrene resin particles, polyethylene resin particles, silica particles, alumina particles, and boron nitride particles.

The average film thickness of the charge transport layer is preferably 5 μm or more and 50 μm or less, more preferably 8 μm or more and 40 μm or less, and particularly preferably 10 μm or more and 30 μm or less.

The charge transport layer can be formed by forming a coating film of the charge transport layer coating liquid containing the above-described materials and a solvent on a surface of the charge generating layer, the surface being opposed to the support-side surface of the layer, and heating and drying the coating film. Herein, the drying temperature of the coating film is preferably higher than at least a boiling point of a solvent having a boiling point of 34° C. or more and 85° C. or less that is contained in the charge transport layer coating liquid. Specifically, for example, the temperature is preferably 100° C. or more and 170° C. or less.

On Charge Generating Layer

Protective Layer

In the present disclosure, a protective layer, which is an optional component, may be disposed on a surface of the photosensitive layer, the surface being opposed to the support-facing side of the photosensitive layer. By disposing a protective layer, durability can be improved.

The protective layer can contain electrically-conductive particles and/or a charge transport material, and a resin.

Examples of the electrically-conductive particles include particles of a metal oxide such as titanium oxide, zinc oxide, tin oxide, or indium oxide.

Examples of the charge transport material include polycyclic aromatic compounds, heterocyclic compounds, hydrazone compounds, styryl compounds, enamine compounds, benzidine compounds, triarylamine compounds, and resins containing groups that are derived from the foregoing materials. Among these, triarylamine compounds and benzidine compounds are preferable.

Examples of the resin include polyester resins, acrylic resins, phenoxy resins, polycarbonate resins, polystyrene resins, phenolic resins, melamine resins, and epoxy resins. Among these, polycarbonate resins, polyester resins, and acrylic resins are preferable.

Furthermore, the protective layer may be formed by polymerizing a composition containing a monomer having a polymerizable functional group and thereby forming a cured film. Examples of the reaction in this process include thermal polymerization reactions, photopolymerization reactions, and radiation-induced polymerization reactions. Examples of the polymerizable functional groups of the monomer having a polymerizable functional group include acrylic groups and methacrylic groups. A material having charge transport capabilities may be used as the monomer having a polymerizable functional group.

The protective layer may further contain additives such as antioxidants, ultraviolet absorbers, plasticizers, leveling agents, slip agents, and abrasion resistance improvers. Specific examples of the additives include hindered phenolic compounds, hindered amine compounds, sulfur compounds, phosphorus compounds, benzophenone compounds, siloxane-modified resins, silicone oil, fluorine resin particles, polystyrene resin particles, polyethylene resin particles, silica particles, alumina particles, and boron nitride particles.

The average film thickness of the protective layer is preferably 0.5 μm or more and 10 μm or less, more preferably 1 μm or more and 7 μm or less.

The protective layer can be formed by preparing a protective layer coating liquid containing the above-described materials and a solvent, forming a coating film of the liquid, and drying and/or curing the coating film. Examples of the solvent used for the coating liquid include alcohol solvents, ketone solvents, ether solvents, sulfoxide solvents, ester solvents, and aromatic hydrocarbon solvents.

Process Cartridge, Electrophotographic Apparatus

A process cartridge according to one aspect of the present disclosure supports the above-described electrophotographic photoconductor and at least one unit selected from the group consisting of a charging unit, a developing unit, a transfer unit, and a cleaning unit altogether and is detachably attached to the main body of an electrophotographic apparatus.

Furthermore, an electrophotographic apparatus according to one aspect of the present disclosure includes the above-described electrophotographic photoconductor, a charging unit, an exposure unit, a developing unit, and a transfer unit.

Figure 2:
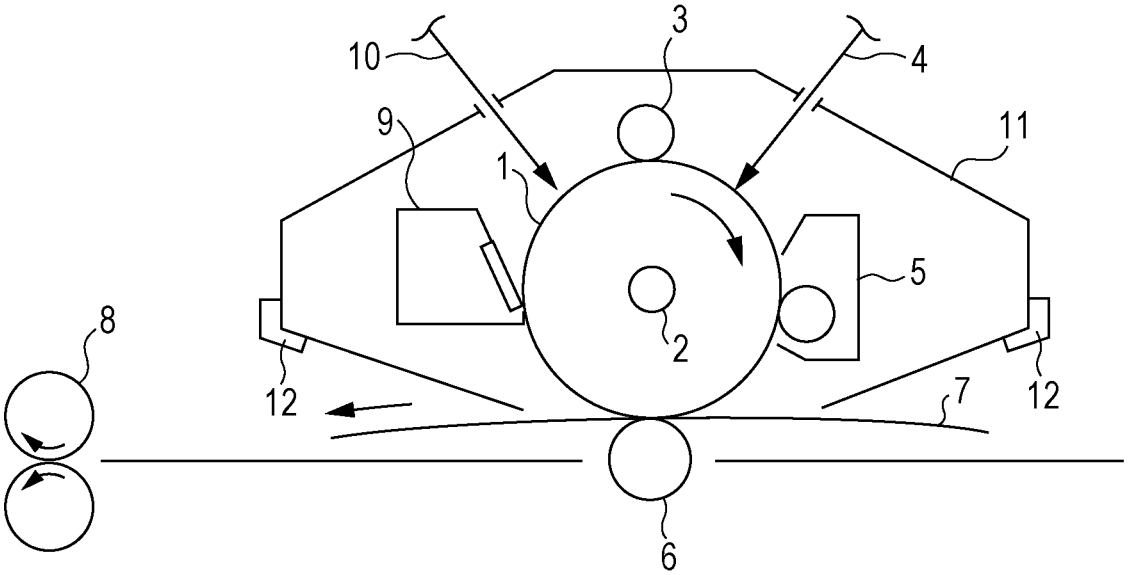
FIG. 2 is a schematic view of an electrophotographic apparatus including a process cartridge that includes the electrophotographic photoconductor according to an embodiment of the present disclosure.

FIG. 2 illustrates an example of a schematic structure of an electrophotographic apparatus including a process cartridge that includes the electrophotographic photoconductor.

A cylindrical electrophotographic photoconductor 1 is caused to rotate about an axis 2 in the direction indicated by an arrow at a predetermined circumferential velocity. The surface of the electrophotographic photoconductor 1 is charged with a predetermined positive potential or a predetermined negative potential by a charging unit 3. While FIG. 2 illustrates a charging roller technique with a charging roller member, a charging technique such as a corona charging technique, a proximity charging technique, or an injection charging technique may be adopted. The charged surface of the electrophotographic photoconductor 1 is irradiated with exposure light 4 by an exposure unit (not illustrated) to form an electrostatic latent image corresponding to intended image information. The electrostatic latent image formed on the surface of the electrophotographic photoconductor 1 is developed by toner contained in a developing unit 5 to form a toner image on the surface of the electrophotographic photoconductor 1. The toner image formed on the surface of the electrophotographic photoconductor 1 is transferred to a transfer material 7 by a transfer unit 6. The transfer material 7 where the toner image has been transferred is conveyed to a fixing unit 8, subjected to a toner image fixing process, and printed to outside the electrophotographic apparatus. The electrophotographic apparatus may include a cleaning unit 9 for removing any adhering matter such as toner remaining on the surface of the electrophotographic photoconductor 1 after transfer. Furthermore, instead of separately disposing any cleaning unit, a so-called cleanerless system that removes such adhering matter with, for example, a developing unit may be used. The electrophotographic apparatus may include a discharge mechanism that subjects the surface of the electrophotographic photoconductor 1 to a discharging process with pre-exposure light 10 from a pre-exposure unit (not illustrated). Furthermore, a guiding unit 12, such as a rail, may be disposed so that the process cartridge according to one aspect of the present disclosure is attached to and detached from the main body of the electrophotographic apparatus.

The electrophotographic photoconductor according to the present disclosure can be used for laser beam printers, LED printers, and copying machines.

Method for Measuring Film Thickness

Examples of methods for measuring film thickness for an electrophotographic photoconductor include various methods including a method in which mass per unit area is converted to specific gravity, a method using a step gauge, contact techniques such as an eddy current technique and an ultrasonic technique, and noncontact techniques such as an optical interference technique and an optical absorption technique. Among them, as a method for easily measuring film thickness at a plurality of locations in the surface of a photoconductor, an optical interference technique which enables non-contact, non-destructive measurement is effective.

The principle of one method for measuring film thickness using an optical interference technique is as follows. When a coating film having a refractive index of n and a film thickness of d formed on a substrate is irradiated with light, a composite wave formed from a reflected light ray from the front surface of the coating film and a reflected light ray from the back surface of the coating film after penetrating the coating film is obtainable as a reflected light ray. When this reflected light ray is dispersed, a wavelength-dependent interference spectrum that is caused by an optical interference phenomenon resulting from the optical path difference 2nd between the reflected light ray from the front surface of the film and the reflected light ray from the back surface of the film is obtainable. For example, when the incident wavelength is an integral multiple of the optical path difference, the phases of reflected light rays match each other, resulting in high reflection intensity. On the other hand, when the incident wavelength undergoes a half-cycle phase shift due to the optical path difference, the phases of reflected light rays cancel each other out, resulting in low reflection intensity. Thus, when a reflected light ray reflected from a coating film having a certain film thickness of d is dispersed, an interference spectrum exhibiting continuous intensity oscillations is obtainable. This method of calculating film thickness from this interference spectrum and the refractive index of a coating film is referred to as an "optical interference technique".

In actual measurement, in which reflected light rays that have repeatedly undergone multiple reflection and scattering in a coating film are dealt with, optimal measurement conditions need to be determined according to the characteristics of a coating film and a substrate to obtain an accurate interference spectrum.

Particularly when the measurement target is a photoconductor, to suppress interference fringes, the measurement is to be targeted at a coating film on a physically and chemically roughened base or on a rough substrate such as an electrically-conductive layer for covering the unevenness and defects of a base. As a result, an accurate interference spectrum may not be obtained.

In an interference spectrum containing reflected light rays from top of a rough substrate, an optical path difference occurring depending on roughness profile causes different phases to cancel each other out within the diameter of the irradiation spot. As a result, the wavelength dependence of the interference spectrum is lost. When a coating film on such a rough substrate is measured, the diameter of the irradiation spot is selected, depending on roughness profile, such that a change in the optical path difference occurring within the diameter of the irradiation spot decreases. For example, when the film thickness on an electrically-conductive base such as ones illustrated in the Manufacturing Examples of the photoconductor according to the present disclosure is measured, a diameter of the irradiation spot of 50 μm or less may be selected.

Furthermore, as the wavelength is shorter, the susceptibility to the impact of scattering resulting from substrate roughness is likely to increase, and the wavelength dispersion of a refractive index is likely to reduce peak-valley intervals of an interference spectrum, resulting in high susceptibility to the impact of phase cancellation. To avoid this, a long-wavelength range may be selected as the wavelength range. For example, when the measurement target is about tens of μm of the film thickness of the charge transport layer as illustrated in the Manufacturing Examples of the photoconductor according to the present disclosure, an interference spectrum obtained in the region from 700 nm to around the near infrared region may be targeted.

Examples of the light source include LEDs, SLDs, and lamps such as xenon lamps and mercury-xenon lamps. A light source can be used together with an appropriate wavelength filter so as to provide light with a desired wavelength range. Furthermore, the spot diameter can be narrowed to a desired diameter by using commercially available optical lenses and apertures.

For detecting reflected light rays, a light receiver including a spectrometer and a photoelectric conversion element is used. For example, a CCD is often used for detection in the ultraviolet region to the visible region, and a photodiode using InGaAs is often used for detection in the infrared region. As needed, irradiation wavelength ranges or the wavelength ranges needed for detection are detected, and wavelength ranges other than the foregoing may also be included.

The resultant interference spectrum can be analyzed by various methods employing an arithmetic calculation such as a peak-valley method, a curve-fitting method, or an FFT method to determine film thickness.

The above-described measurement mechanisms and conditions may be replicated by using a commercially available spectral interference type film thickness meter. For example, the following devices are usable.

Film thickness measurement system F20, manufactured by Filmetrics, Inc.

Spectral interference displacement type multilayer film thickness meter SI-T80, manufactured by Keyence Corporation MCPD-6800, manufactured by Otsuka Electronics Co., Ltd.

OPTM-F2, manufactured by Otsuka Electronics Co., Ltd.

C13027-11, manufactured by Hamamatsu Photonics K.K.

According to the present disclosure, an electrophotographic photoconductor where a charge transport layer formed through immersion-coating has higher uniformity in film thickness can be obtained.

EXAMPLES

Hereafter, an electrophotographic photoconductor and the like according to the present disclosure will be described in further detail with reference to Examples and Comparative Examples. The following Examples are not intended to limit the present disclosure as long as they do not depart from the spirit of the present disclosure. In the description of the following Examples, the unit "parts" is on a mass basis unless otherwise indicated.

Manufacturing of Electrophotographic Photoconductor

Preparation Example of Electrically-Conductive Layer Coating Liquid

Into a sand mill using 450 parts of glass beads having a diameter of 0.8 mm, 207 parts of titanium oxide ($TiO_2$) particles (average primary particle size: 230 nm) covered with tin oxide ($SnO_2$) doped with phosphorus (P), 144 parts of a phenolic resin (product name: Plyohfen J-325, manufactured by Dainippon Ink and Chemicals, Inc.), and 98 parts of 1-methoxy-2-propanol were placed, and the mixture was subjected to a dispersion process at a rotation speed of 2,000 rpm, for a dispersion process time of four and a half hours, and with the temperature of cooling water set to 18° C. to obtain a dispersion liquid. The glass beads were removed from the dispersion liquid with a mesh (mesh size: 150 μm).

To the dispersion liquid from which the glass beads had been removed, silicone resin particles (product name: Tospearl 120, manufactured by Momentive Performance Materials, Inc.) were added so as to be contained in an amount of 15% by mass with respect to the total mass of the metal oxide particles and a binding material in the dispersion liquid. Furthermore, silicone oil (product name: SH28PA, manufactured by Dow Corning Toray Co., Ltd.) was added to the dispersion liquid so as to be contained in an amount of 0.01% by mass with respect to the total mass of the metal oxide particles and the binding material in the dispersion liquid.

Next, a mixed solvent of methanol and 1-methoxy-2-propanol (mass ratio: 1:1) was added to the dispersion liquid such that the total mass of the metal oxide particles, the binding material, and a surface roughening material are contained in an amount of 67% by mass with respect to the mass of the dispersion liquid, and the mixture was stirred to prepare an electrically-conductive layer coating liquid.

Preparation Example of Undercoat Layer Coating Liquid

In a mixed solvent of 65 parts of methanol and 30 parts of n-butanol, 4.5 parts of N-methoxy methylated nylon (product name: Tresin EF-30, manufactured by Nagase ChemteX Corporation) and 1.5 parts of a nylon copolymer (product name: Amilan CM8000 manufactured by Toray Co., Ltd.) were dissolved to prepare an undercoat layer coating liquid.

Preparation Example of Charge Generating Layer Coating Liquid

With reference to the method disclosed in Japanese Patent Laid-Open No. 2014-160238, 10 parts of hydroxy gallium phthalocyanine having distinct peaks at Bragg angles (2θ+0.2°) of 7.5°, 9.9°, 16.3°, 18.6°, 25.1°, and 28.3° in CuKα characteristic X-ray diffraction, 5 parts of polyvinyl butyral (product name: S-Lec BX-1, manufactured by Sekisui Chemical Co., Ltd.), and 250 parts of cyclohexanone were dispersed with a sand mill apparatus using glass beads with a diameter of 41 mm for one hour, after which 250 parts of ethyl acetate was added thereto to prepare a charge generation layer coating liquid 1.

Preparation Example of Charge Transport Layer Coating Liquid

In a mixed solvent of 30 parts of ortho-xylene and 20 parts of methyl benzoate, 0.9 parts of a compound represented by Formula (CTM-1) and 8.1 parts of a compound represented by Formula (CTM-3) were dissolved.

To the dispersion liquid, 10 parts of a polyester resin represented by Formula (PE-II-1), Formula (PE-III-1), and Formula (PE-III-2), 0.2 parts of comb-shaped silicone (product name: Aron GS101, manufactured by Toagosei Co., Ltd.) serving as an additive, and 50 parts of dimethoxymethane were added to prepare a charge transport layer coating liquid 2.

(CTM-1)

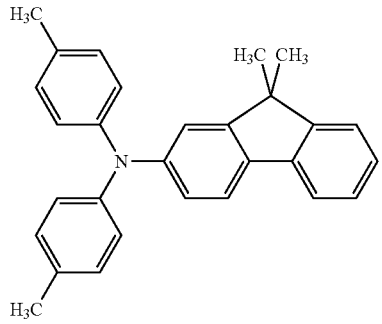

(CTM-3)

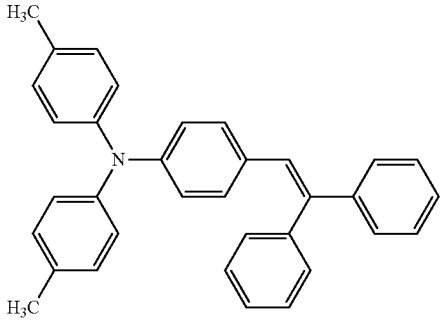

The polyester resin is a polyester resin having a 100 mol % content of the structure represented by Formula (PE-II-1), 50 mol % content of the structure represented by Formula (PE-III-1), and 50 mol % content of the structure represented by Formula (PE-III-2). Furthermore, the weight average molecular weight of the polyester resin is 120,000.

(PE-II-1)

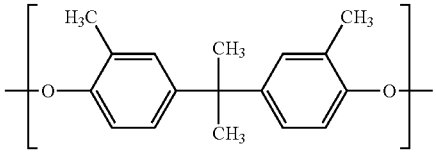

(PE-III-1)

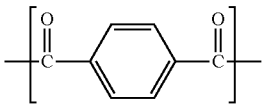

(PE-III-2)

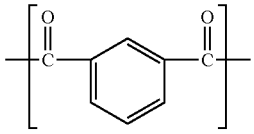

Manufacturing Example of Electrophotographic Photoconductor 1

A cylindrical aluminum cylinder (JIS-A3003, aluminum alloy) manufactured through a manufacturing method that includes an extrusion step and a drawing step and having a length of 257 mm and a diameter of 24 mm was used as a support.

With an upper portion of the cylindrical support held, for example, in a sealing manner, the support was immersed in and coated with each of the below-described coating liquids. The coated support was pulled out and each of the layers was formed under each of the heat drying conditions.

The expression "holding in a sealing manner" refers to a technique for suppressing the escape of gas (e.g., air) inside a cylinder space of the cylinder from an upper end of the cylinder during immersion. In the present disclosure, complete sealing may be preferable to prevent the gas inside the cylinder space from escaping from the upper end of the cylinder. However, in the present disclosure, sealing is not required as long as the gas can be retained inside the cylinder space despite a certain amount of gas escaping from the upper end of the cylinder. When gas is retained inside the cylinder space, for example, excessive adherence of a coating liquid to the inner wall of the cylinder can be suppressed.

The top of the support was immersion-coated with an electrically-conductive layer coating liquid in a normal-temperature and normal-humidity environment (temperature of 23° C., relative humidity of 50%), and the resultant coating film was dried and thermally cured for 30 minutes at a temperature of 170° C. to form an electrically-conductive layer having a film thickness of 30 μm.

Next, the top of the electrically-conductive layer was immersion-coated with an undercoat layer coating liquid, and the resultant coating film was dried for ten minutes at a temperature of 100° C. to form an undercoat layer of a film thickness of 1.0 μm.

Next, the top of the undercoat layer was immersion-coated with a charge generating layer coating liquid, and the resultant coating film was dried for ten minutes at a temperature of 100° C. to form a charge generating layer having a film thickness of 0.15 μm.

The support where the charge generating layer was formed after the drying step was cooled by delivering airflow to the support with fanning mechanisms by using the apparatus illustrated in FIG. 1.

The average of the surface temperatures of the charge generating layer formed on the support before applying a charge transport layer thereto was set to 23.1° C. (Table 2), and the difference between the maximum value and the minimum value of the surface temperatures of regions T1, T2, T3, T4, and T5, the regions being formed by dividing the support into fifths in the longitudinal direction, was 1.0° C. or less (Table 2). The average of the surface temperatures of the charge generating layer was determined by measuring, in the circumferential direction, the temperatures at four locations in each of the regions T1, T2, T3, T4, and T5, the regions being formed by dividing the support into fifths in the longitudinal direction, and averaging all the measured values. Furthermore, the temperature of the charge transport layer coating liquid was set to 21.5° C. (Table 2). Next, the top of the charge generating layer was immersion-coated with the charge transport layer coating liquid, and the resultant coating film was dried for 30 minutes at 125° C. to form a charge transport layer. The film thickness of the charge transport layer is presented in Table 4 below.

Manufacturing Examples of Electrophotographic Photoconductors 2 to 13

The same operations as in Manufacturing Example of the electrophotographic photoconductor 1 were performed to manufacture electrophotographic photoconductors 2 to 13 except that the surface temperatures in T1 to T5 and the average temperature of the charge generating layer on the support before the support was immersed in the charge transport layer coating liquid and the temperature of the charge transport layer coating liquid were changed to temperatures presented in Table 2.

Manufacturing Examples of Electrophotographic Photoconductors 14 to 17

The same operations as in Manufacturing Example of the electrophotographic photoconductor 1 were performed to manufacture electrophotographic photoconductors 14 to 17 except that the surface temperatures in T1 to T5 and the average temperature of the charge generating layer on the support before the support was immersed in the charge transport layer coating liquid and the temperature of the charge transport layer coating liquid were changed to temperatures presented in Table 3.

Manufacturing Example of Electrophotographic Photoconductor 18

The same operations as in Manufacturing Example of the electrophotographic photoconductor 1 were performed to manufacture an electrophotographic photoconductor 18 except that the support where the charge generating layer was formed after the drying step was allowed to cool in air for 20 minutes without using the apparatus illustrated in FIG. 1.

TABLE 2

| Manufacturing Examples | Temperatures at four locations in regions T1 to T5 (fifths in longitudinal direction) in circumferential direction (° C.) | | | | | Max temperature (° C.) | Min temperature (° C.) | Temperature difference in T1 to T5 (° C.) | Average surface temperature of drum (° C.) | Temperature of CTL coating material (° C.) | Temperature difference from coating material (° C.) |
|---|---|---|---|---|---|---|---|---|---|---|---|
| 1 | T1 | 22.8 | 22.7 | 23.0 | 22.8 | 23.6 | 22.7 | 0.9 | 23.1 | 21.5 | 1.6 |
| | T2 | 23.1 | 23.2 | 22.9 | 23.0 | | | | | | |
| | T3 | 23.3 | 23.1 | 23.4 | 22.9 | | | | | | |
| | T4 | 23.2 | 23.6 | 23.3 | 23.1 | | | | | | |
| | T5 | 23.2 | 23.4 | 23.1 | 23.5 | | | | | | |
| 2 | T1 | 22.8 | 22.7 | 22.9 | 23.0 | 23.5 | 22.6 | 0.9 | 23.0 | 20.2 | 2.8 |
| | T2 | 22.7 | 22.8 | 22.6 | 23.1 | | | | | | |
| | T3 | 22.6 | 22.9 | 23.0 | 22.8 | | | | | | |
| | T4 | 23.2 | 22.8 | 22.9 | 23.4 | | | | | | |
| | T5 | 23.1 | 23.4 | 23.2 | 23.5 | | | | | | |
| 3 | T1 | 23.4 | 23.4 | 22.9 | 23.2 | 23.6 | 22.8 | 0.8 | 23.2 | 18.3 | 4.9 |
| | T2 | 23.6 | 23.3 | 23.1 | 23.5 | | | | | | |
| | T3 | 23.4 | 23.4 | 23.0 | 23.5 | | | | | | |
| | T4 | 22.8 | 22.8 | 23.3 | 22.9 | | | | | | |
| | T5 | 22.9 | 23.3 | 23.4 | 23.0 | | | | | | |
| 4 | T1 | 19.7 | 19.8 | 19.9 | 19.8 | 20.1 | 19.7 | 0.4 | 19.9 | 18.3 | 1.6 |
| | T2 | 20.0 | 19.9 | 20.0 | 19.8 | | | | | | |
| | T3 | 19.9 | 20.1 | 19.9 | 20.0 | | | | | | |
| | T4 | 20.0 | 19.9 | 20.0 | 19.9 | | | | | | |
| | T5 | 19.9 | 20.0 | 20.0 | 19.9 | | | | | | |
| 5 | T1 | 28.2 | 27.8 | 27.4 | 28.0 | 28.4 | 27.4 | 1 | 27.9 | 26.4 | 1.5 |
| | T2 | 27.8 | 28.0 | 27.6 | 28.4 | | | | | | |
| | T3 | 28.3 | 27.6 | 27.7 | 28.0 | | | | | | |
| | T4 | 27.7 | 28.4 | 28.0 | 28.3 | | | | | | |
| | T5 | 27.8 | 28.3 | 27.4 | 28.0 | | | | | | |
| 6 | T1 | 28.3 | 28.0 | 27.6 | 28.4 | 28.4 | 27.4 | 1 | 28.0 | 25.2 | 2.8 |
| | T2 | 27.8 | 28.4 | 27.6 | 28.0 | | | | | | |
| | T3 | 27.8 | 28.3 | 27.6 | 28.0 | | | | | | |
| | T4 | 28.4 | 28.0 | 27.7 | 28.3 | | | | | | |
| | T5 | 27.4 | 28.3 | 27.5 | 28.0 | | | | | | |
| 7 | T1 | 28.4 | 28.0 | 27.6 | 28.0 | 28.4 | 27.4 | 1 | 28.0 | 23.0 | 5.0 |
| | T2 | 27.5 | 28.3 | 28.0 | 27.9 | | | | | | |
| | T3 | 28.0 | 28.2 | 27.6 | 28.3 | | | | | | |
| | T4 | 28.2 | 28.4 | 27.5 | 27.8 | | | | | | |
| | T5 | 28.3 | 28.0 | 27.9 | 27.4 | | | | | | |
| 8 | T1 | 25.2 | 24.9 | 25.3 | 24.6 | 25.3 | 24.6 | 0.7 | 25.0 | 23.5 | 1.5 |
| | T2 | 24.8 | 24.7 | 25.2 | 25.3 | | | | | | |
| | T3 | 25.3 | 24.9 | 24.7 | 25.1 | | | | | | |
| | T4 | 25.0 | 25.2 | 24.9 | 24.6 | | | | | | |
| | T5 | 25.1 | 25.3 | 24.6 | 25.0 | | | | | | |
| 9 | T1 | 25.1 | 25.3 | 24.6 | 24.9 | 25.3 | 24.4 | 0.9 | 24.9 | 22.0 | 2.9 |
| | T2 | 24.4 | 25.0 | 25.1 | 24.8 | | | | | | |
| | T3 | 25.2 | 25.0 | 24.9 | 24.6 | | | | | | |
| | T4 | 25.3 | 24.8 | 24.9 | 24.7 | | | | | | |
| | T5 | 24.9 | 25.3 | 24.7 | 25.0 | | | | | | |
| 10 | T1 | 24.9 | 24.8 | 25.3 | 24.6 | 25.3 | 24.6 | 0.7 | 25.0 | 20.0 | 5.0 |
| | T2 | 25.0 | 25.1 | 24.6 | 25.2 | | | | | | |
| | T3 | 25.3 | 24.7 | 24.9 | 25.0 | | | | | | |
| | T4 | 25.3 | 24.6 | 25.1 | 24.9 | | | | | | |
| | T5 | 25.0 | 25.2 | 24.6 | 24.9 | | | | | | |
| 11 | T1 | 30.4 | 29.5 | 29.9 | 29.8 | 30.4 | 29.4 | 1 | 29.9 | 28.4 | 1.5 |
| | T2 | 29.4 | 30.3 | 29.8 | 30.0 | | | | | | |
| | T3 | 30.4 | 29.8 | 30.0 | 29.6 | | | | | | |
| | T4 | 30.0 | 29.5 | 30.4 | 30.2 | | | | | | |
| | T5 | 29.9 | 30.3 | 29.8 | 29.5 | | | | | | |
| 12 | T1 | 30.3 | 29.9 | 30.0 | 29.5 | 30.4 | 29.5 | 0.9 | 30.0 | 27.0 | 3.0 |
| | T2 | 29.5 | 30.4 | 30.0 | 30.1 | | | | | | |
| | T3 | 29.8 | 30.0 | 30.3 | 29.8 | | | | | | |
| | T4 | 30.4 | 29.6 | 30.2 | 30.0 | | | | | | |
| | T5 | 29.9 | 29.5 | 30.0 | 30.4 | | | | | | |
| 13 | T1 | 30.0 | 30.4 | 29.9 | 29.5 | 30.4 | 29.4 | 1 | 29.8 | 25.0 | 4.8 |
| | T2 | 30.3 | 29.5 | 29.8 | 29.7 | | | | | | |
| | T3 | 29.7 | 29.4 | 30.4 | 29.8 | | | | | | |
| | T4 | 30.3 | 29.4 | 29.8 | 30.0 | | | | | | |
| | T5 | 29.5 | 29.6 | 30.3 | 29.4 | | | | | | |

TABLE 3

| Comparative Manufacturing Examples | Temperatures at four locations in regions T1 to T5 (fifths in longitudinal direction) in circumferential direction (° C.) | | | | | Max temperature (° C.) | Min temperature (° C.) | Temperature difference in T1 to T5 (° C.) | Average surface temperature of drum (° C.) | Temperature of CTL coating material (° C.) | Temperature difference from coating material (° C.) |
|---|---|---|---|---|---|---|---|---|---|---|---|
| 14 | T1 | 20.0 | 18.9 | 19.2 | 19.5 | 20.1 | 18.9 | 1.2 | 19.8 | 20.0 | −0.2 |
| | T2 | 19.8 | 19.9 | 19.5 | 19.8 | | | | | | |
| | T3 | 20.1 | 19.6 | 19.9 | 20.0 | | | | | | |
| | T4 | 20.0 | 19.9 | 20.1 | 19.9 | | | | | | |
| | T5 | 19.9 | 20.0 | 20.0 | 19.9 | | | | | | |
| 15 | T1 | 22.0 | 22.7 | 22.9 | 22.4 | 23.7 | 22.0 | 1.7 | 22.9 | 20.0 | 2.9 |
| | T2 | 22.7 | 22.8 | 22.6 | 23.1 | | | | | | |
| | T3 | 22.6 | 22.9 | 23.0 | 22.8 | | | | | | |
| | T4 | 23.2 | 22.8 | 22.9 | 23.4 | | | | | | |
| | T5 | 23.1 | 23.4 | 23.2 | 23.7 | | | | | | |
| 16 | T1 | 27.5 | 26.5 | 25.8 | 26.1 | 28.0 | 25.6 | 2.4 | 26.9 | 20.0 | 6.9 |
| | T2 | 26.0 | 27.2 | 26.3 | 26.1 | | | | | | |
| | T3 | 27.6 | 26.4 | 26.5 | 27.4 | | | | | | |
| | T4 | 26.5 | 25.6 | 27.6 | 28.0 | | | | | | |
| | T5 | 27.8 | 27.3 | 26.9 | 28.0 | | | | | | |
| 17 | T1 | 29.3 | 28.3 | 27.8 | 28.6 | 31.0 | 27.8 | 3.2 | 29.3 | 20.0 | 9.3 |
| | T2 | 28.3 | 30.3 | 28.0 | 30.0 | | | | | | |
| | T3 | 31.0 | 28.2 | 30.0 | 29.6 | | | | | | |
| | T4 | 30.0 | 29.5 | 30.4 | 28.0 | | | | | | |
| | T5 | 28.3 | 30.3 | 29.8 | 29.5 | | | | | | |
| 18 | T1 | 25.6 | 26.5 | 24.8 | 25.0 | 31.5 | 24.8 | 6.7 | 27.8 | 25.0 | 2.8 |
| | T2 | 26.7 | 26.1 | 26.8 | 26.0 | | | | | | |
| | T3 | 27.0 | 27.5 | 28.0 | 27.8 | | | | | | |
| | T4 | 29.0 | 29.5 | 28.9 | 28.7 | | | | | | |
| | T5 | 30.5 | 31.0 | 31.5 | 29.5 | | | | | | |

Evaluation

Film Thickness Evaluation of Electrophotographic Photoconductors

The film thickness of the charge transport layer of each of the above-described electrophotographic photoconductors 1 to 18 was evaluated with a laser interference type film thickness meter (product name: SI-T80U, manufactured by Keyence Corporation). Photoconductor surfaces were measured by scanning the electrophotographic photoconductors held in a static state in the longitudinal direction and rotating the photoconductors in the circumferential direction. The results of the film thickness measured at four locations in each of the regions T1, T2, T3, T4, and T5, the regions being formed by dividing the support into fifths in the longitudinal direction, that is, at every 90 degrees in the circumferential direction, are presented in Tables 4 and 5.

TABLE 4

| Examples | Film thickness at four locations in regions T1 to T5 (fifths in longitudinal direction) in circumferential diretion (μm) | | | | | Max film thickness (μm) | Min film thickness (μm) | Film thickness difference in T1 to T5 (μm) |
|---|---|---|---|---|---|---|---|---|
| Example 1 | T1 | 24.2 | 24.0 | 23.9 | 24.2 | 24.2 | 23.5 | 0.7 |
| | T2 | 23.9 | 23.8 | 24.2 | 24.0 | | | |
| | T3 | 23.6 | 23.5 | 24.0 | 23.9 | | | |
| | T4 | 23.8 | 23.6 | 23.7 | 23.8 | | | |
| | T5 | 23.8 | 23.5 | 23.9 | 23.5 | | | |
| Example 2 | T1 | 25.2 | 25.2 | 25.1 | 25.0 | 25.3 | 24.8 | 0.5 |
| | T2 | 25.3 | 25.2 | 25.3 | 25.0 | | | |
| | T3 | 25.0 | 25.2 | 24.9 | 25.2 | | | |
| | T4 | 24.8 | 25.1 | 25.1 | 24.8 | | | |
| | T5 | 25.0 | 24.8 | 25.0 | 24.9 | | | |
| Example 3 | T1 | 25.8 | 25.8 | 26.1 | 25.9 | 26.1 | 25.8 | 0.3 |
| | T2 | 25.9 | 25.9 | 26.0 | 25.8 | | | |
| | T3 | 25.9 | 25.9 | 26.0 | 25.9 | | | |
| | T4 | 25.8 | 25.9 | 25.8 | 25.9 | | | |
| | T5 | 25.9 | 26.0 | 25.8 | 25.9 | | | |
| Example 4 | T1 | 27.1 | 27.2 | 27.1 | 27.2 | 27.2 | 26.9 | 0.3 |
| | T2 | 27.0 | 27.1 | 27.0 | 27.2 | | | |
| | T3 | 27.1 | 26.9 | 27.1 | 27.0 | | | |
| | T4 | 27.0 | 27.1 | 27.0 | 27.1 | | | |
| | T5 | 27.1 | 27.0 | 27.0 | 27.1 | | | |
| Example 5 | T1 | 21.8 | 21.7 | 22.5 | 22.2 | 22.5 | 21.5 | 1 |
| | T2 | 22.4 | 22.0 | 22.4 | 21.6 | | | |
| | T3 | 21.7 | 21.5 | 22.0 | 22.2 | | | |
| | T4 | 22.3 | 21.7 | 22.0 | 21.6 | | | |
| | T5 | 22.3 | 21.7 | 22.4 | 22.0 | | | |
| Example 6 | T1 | 21.7 | 22.0 | 22.3 | 21.7 | 22.5 | 21.6 | 0.9 |
| | T2 | 22.2 | 21.6 | 22.3 | 22.0 | | | |
| | T3 | 22.2 | 21.7 | 21.9 | 22.1 | | | |

TABLE 4-continued

| Examples | Film thickness at four locations in regions T1 to T5 (fifths in longitudinal direction) in circumferential diretion (μm) | | | | | Max film thickness (μm) | Min film thickness (μm) | Film thickness difference in T1 to T5 (μm) |
|---|---|---|---|---|---|---|---|---|
| | T4 | 21.6 | 22.0 | 22.3 | 21.8 | | | |
| | T5 | 22.4 | 21.9 | 22.5 | 22.0 | | | |
| Example 7 | T1 | 21.6 | 21.9 | 22.2 | 22.0 | 22.2 | 21.5 | 0.7 |
| | T2 | 22.2 | 21.7 | 22.0 | 22.1 | | | |
| | T3 | 22.0 | 21.6 | 22.2 | 21.9 | | | |
| | T4 | 21.8 | 21.9 | 22.0 | 22.1 | | | |
| | T5 | 21.5 | 22.0 | 22.1 | 21.9 | | | |
| Example 8 | T1 | 22.8 | 23.1 | 22.7 | 23.4 | 23.4 | 22.7 | 0.7 |
| | T2 | 23.2 | 23.3 | 22.8 | 22.7 | | | |
| | T3 | 22.7 | 23.1 | 23.3 | 22.9 | | | |
| | T4 | 23.0 | 22.7 | 23.1 | 23.4 | | | |
| | T5 | 22.9 | 22.7 | 23.4 | 23.0 | | | |
| Example 9 | T1 | 22.9 | 22.7 | 23.2 | 23.1 | 23.4 | 22.7 | 0.7 |
| | T2 | 23.3 | 23.0 | 22.7 | 23.2 | | | |
| | T3 | 22.8 | 23.0 | 22.9 | 23.3 | | | |
| | T4 | 22.8 | 23.2 | 23.1 | 23.4 | | | |
| | T5 | 23.1 | 22.7 | 23.2 | 23.0 | | | |
| Example 10 | T1 | 23.1 | 23.0 | 22.8 | 22.7 | 23.2 | 22.7 | 0.5 |
| | T2 | 23.0 | 22.7 | 23.1 | 22.8 | | | |
| | T3 | 22.7 | 23.2 | 23.1 | 23.0 | | | |
| | T4 | 22.7 | 23.2 | 22.9 | 23.1 | | | |
| | T5 | 23.0 | 22.7 | 23.1 | 23.1 | | | |
| Example 11 | T1 | 19.6 | 20.6 | 20.1 | 20.2 | 20.6 | 19.6 | 1 |
| | T2 | 20.6 | 19.6 | 20.2 | 20.0 | | | |
| | T3 | 19.6 | 20.2 | 20.0 | 20.5 | | | |
| | T4 | 20.0 | 20.5 | 19.6 | 19.8 | | | |
| | T5 | 20.1 | 19.6 | 20.2 | 20.6 | | | |
| Example 12 | T1 | 19.7 | 20.1 | 20.0 | 20.4 | 20.5 | 19.6 | 0.9 |
| | T2 | 20.4 | 19.6 | 20.0 | 19.9 | | | |
| | T3 | 20.5 | 20.0 | 19.7 | 20.2 | | | |
| | T4 | 19.6 | 20.4 | 19.8 | 20.0 | | | |
| | T5 | 20.1 | 20.4 | 20.0 | 19.6 | | | |
| Example 13 | T1 | 20.0 | 19.6 | 20.1 | 20.2 | 20.3 | 19.6 | 0.7 |
| | T2 | 19.7 | 20.3 | 20.2 | 20.0 | | | |
| | T3 | 20.3 | 20.2 | 19.6 | 20.2 | | | |
| | T4 | 19.7 | 20.3 | 20.2 | 20.0 | | | |
| | T5 | 20.3 | 20.3 | 19.7 | 20.2 | | | |

TABLE 5

| Comparative Examples | Film thickness at four locations in regions T1 to T5 (fifths in longitudinal direction) in circumferential direction (μm) | | | | | Max film thickness (μm) | Min film thickness (μm) | Film thickness difference in T1 to T5 (μm) | |
|---|---|---|---|---|---|---|---|---|---|
| Comparative Example 1 | T1 | 27.0 | 28.1 | 27.8 | 27.5 | 36.0 | 20.0 | 16 | Significant film disorder occurred in T4 and T5 due to the occurence of foaming |
| | T2 | 27.2 | 27.1 | 27.5 | 27.2 | | | | |
| | T3 | 26.8 | 27.4 | 27.1 | 27.0 | | | | |
| | T4 | 30.0 | 35.0 | 20.0 | 24.0 | | | | |
| | T5 | 32.0 | 36.0 | 24.0 | 27.1 | | | | |
| Comparative Example 2 | T1 | 26.1 | 25.2 | 25.1 | 25.6 | 26.1 | 24.1 | 2 | |
| | T2 | 25.3 | 25.2 | 25.4 | 24.9 | | | | |
| | T3 | 25.4 | 25.2 | 25.0 | 25.2 | | | | |
| | T4 | 24.8 | 25.1 | 25.1 | 24.8 | | | | |
| | T5 | 25.0 | 24.8 | 25.0 | 24.1 | | | | |
| Comparative Example 3 | T1 | 20.5 | 21.5 | 22.2 | 21.9 | 22.2 | 19.0 | 3.2 | |
| | T2 | 22.0 | 21.7 | 21.7 | 21.9 | | | | |
| | T3 | 22.0 | 21.6 | 22.2 | 21.6 | | | | |
| | T4 | 21.5 | 20.4 | 22.0 | 19.0 | | | | |
| | T5 | 21.5 | 21.7 | 22.1 | 19.0 | | | | |
| Comparative Example 4 | T1 | 18.7 | 20.7 | 16.2 | 20.4 | 20.7 | 16.2 | 4.5 | |
| | T2 | 19.7 | 17.7 | 20.2 | 18.0 | | | | |
| | T3 | 17.0 | 18.8 | 19.6 | 18.4 | | | | |
| | T4 | 18.0 | 20.3 | 17.8 | 20.0 | | | | |
| | T5 | 20.0 | 17.7 | 18.2 | 18.5 | | | | |
| Comparative Example 5 | T1 | 22.4 | 21.5 | 23.2 | 23.0 | 24.0 | 20.0 | 4 | |
| | T2 | 21.3 | 21.9 | 21.2 | 22.0 | | | | |
| | T3 | 21.0 | 20.5 | 20.0 | 20.2 | | | | |
| | T4 | 22.3 | 22.1 | 20.0 | 20.4 | | | | |
| | T5 | 24.0 | 23.0 | 23.1 | 24.0 | | | | |

As illustrated in Examples 1 to 13, in the case of the electrophotographic photoconductors in the Manufacturing Examples 1 to 13 produced in the range of the temperature conditions according to the present disclosure, the film thickness difference in T1 to T5 was 1.0 μm or less, and this result indicates high uniformity in film thickness. On the other hand, in the case of the electrophotographic photoconductors in the Comparative Manufacturing Examples 14 to 17 produced out of the range of the temperature conditions according to the present disclosure, the result indicates a very large film thickness difference in T1 to T5.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2019-063892, filed Mar. 28, 2019 and Japanese Patent Application No. 2020-032298, filed Feb. 27, 2020, which are hereby incorporated by reference herein in their entirety.

What is claimed is:

1. A method for manufacturing an electrophotographic photoconductor including a charge generating layer and a charge transport layer in this order on a cylindrical electrically-conductive support, comprising the steps of:

(i) immersing the electrically-conductive support in a charge generating layer coating liquid, (ii) pulling the electrically-conductive support out of the charge generating layer coating liquid, (iii) heat drying the support coated with the charge generating layer coating liquid to form the charge generating layer, (iv) cooling the charge generating layer, (v) subjecting the electrically-conductive support on which the charge generating layer has been formed to immersion-coating with a charge transport layer coating liquid while retaining gas inside a cylinder space of the electrically-conductive support to form a coating film of the charge transport layer coating liquid on the charge generating layer, and (vi) drying the coating film of the charge transport layer coating liquid to form the charge transport layer, wherein the charge transport layer coating liquid contains a solvent having a boiling point of 34° C. or more and 85° C. or less, and the step (v) satisfies the Conditions 1 and 2 below:

Condition 1: Before the electrically-conductive support is immersed in the charge transport layer coating liquid, a difference between a maximum value and a minimum value of surface temperatures in regions T1 to T5, the regions being formed by dividing the charge generating layer on the electrically-conductive support into fifths in a longitudinal direction, is 1.0° C. or less, provided that the maximum value and the minimum value are selected from all values measured at four locations in each of the regions T1 to T5 in a circumferential direction; and Condition 2: Before the electrically-conductive support is immersed in the charge transport layer coating liquid, an average of surface temperatures of the charge generating layer formed on the electrically-conductive support is higher than a temperature of the charge transport layer coating liquid, and a difference between the average and the temperature of the charge transport layer coating liquid is 1.5° C. or more and 5.0° C. or less, provided that the average of the surface temperatures is an average of all the values measured at four locations in each of the regions T1 to T5 in a circumferential direction.

2. The method for manufacturing the electrophotographic photoconductor according to claim 1, wherein a difference between a maximum value and a minimum value of film thickness in each of the regions T1 to T5 of the charge transport layer is 1.0 μm or less.

3. The method for manufacturing the electrophotographic photoconductor according to claim 1, wherein in the step (vi), a drying temperature of the coating film is higher than the boiling point of the solvent contained in the charge transport layer coating liquid.

* * * * *